US007180982B2

(12) United States Patent
Schneider et al.

(10) Patent No.: US 7,180,982 B2
(45) Date of Patent: Feb. 20, 2007

(54) GRID FOR THE ABSORPTION OF X-RAYS

(75) Inventors: Stefan Michael Schneider, Aachen (DE); Wolfgang Eckenbach, Aachen (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 204 days.

(21) Appl. No.: 10/502,272

(22) PCT Filed: Jan. 17, 2003

(86) PCT No.: PCT/IB03/00133

§ 371 (c)(1),
(2), (4) Date: Jul. 22, 2004

(87) PCT Pub. No.: WO03/063182

PCT Pub. Date: Jul. 31, 2003

(65) Prior Publication Data

US 2005/0123099 A1 Jun. 9, 2005

(30) Foreign Application Priority Data

Jan. 26, 2002 (DE) ..... 102 02 987

(51) Int. Cl.
*G21K 1/00* (2006.01)

(52) U.S. Cl. ..... 378/154; 250/505.1

(58) Field of Classification Search ..... 378/154, 378/155; 250/505.1
See application file for complete search history.

(56) References Cited

U.S. PATENT DOCUMENTS 3,919,559 A 11/1975 Stevens ..... 250/508
3,988,589 A * 10/1976 Leask ..... 378/149
6,363,136 B1 3/2002 Flisikowski et al.
6,470,072 B1 * 10/2002 Johnson ..... 378/154

FOREIGN PATENT DOCUMENTS

EP 1 182 671 A2 2/2002

* cited by examiner

*Primary Examiner*—Edward J. Glick
*Assistant Examiner*—Jurie Yun
(74) *Attorney, Agent, or Firm*—Driggs, Hogg & Fry Co. L.P.A.

(57) ABSTRACT

The invention relates to an anti-scatter grid for the absorption of X-rays, wherein the wall elements (3) of the grid consist of a thermoplastic (7) with heavy metal particles (8) embedded therein. By using such a mixture, it is possible to produce the wall elements by injection molding, whereby even very finely and complicatedly shaped, in particular two-dimensional, grids may be produced in cost-effective manner.

15 Claims, 2 Drawing Sheets

GRID FOR THE ABSORPTION OF X-RAYS

The invention relates to a grid with wall elements absorbing electromagnetic radiation. It also relates to a detector and an imaging device having such a grid and to a method of producing the grid.

Grids of the above-mentioned type are used for example in X-ray computer tomographs, in flat dynamic X-ray detectors (FDXD), in SPECT (Single Photon Emission Computed Tomography) and PET (Positron Emission Tomography), in order to absorb radiation not desired for imaging, before it reaches the X-ray detector. In computer tomography, undesired radiation comprises secondary radiation for example, which is generated in the tissue of the patient, while in SPECT it comprises radiation for example from object areas which are not of interest. In the simplest case, grids consist of a one-dimensional sandwich structure, in which thin foils of a heavy metal such as for instance lead, tungsten or molybdenum of a thickness of approx. 0.1 mm and a height of approx. 20 mm alternate with a material of low X-ray absorption density, for example air or plastics, of a thickness of approx. 1 mm. Furthermore, more specialized grid structures are known, for example in the form of a two-dimensional grid structure formed of comb elements (c.f. DE 199 47 537 A1 corresponding to EP 1 089 297 A2). Grid production is very complex in particular in the case of such two-dimensional structures, since absorbent material has to be processed in very small layer thicknesses.

Given this background, it is an object of the present invention to provide a grid for the absorption of scattered electromagnetic radiation, which may be produced relatively simply and flexibly in optimum geometries.

This object is achieved by a grid having the features of claim 1, a detector having the features of claim 8, an imaging device having the features of claim 9 and a method having the features of claim 10. Advantageous developments are contained in the dependent claims.

The grid according to the invention comprises wall elements which absorb electromagnetic radiation. The absorbed radiation is preferably X-radiation. The wall elements consist wholly or partially of a homogeneous or heterogeneous mixture of a material which is flowable in the processing state and of an absorption material absorbing the electromagnetic radiation.

Production of the wall elements of the grid from the described mixture has the advantage that complicated and in particular thin structures may be produced simply, allowing a grid structure of optimum geometry. This flexibility of shape is possible in that a material which is flowable in the processing state is used, which contains the material absorbing electromagnetic radiation and thereby likewise makes it "flowable" from the point of view of processing. The mixture may therefore be loaded into virtually any desired molds in the processing state, the mold shape being retained after solidification of the mixture. Lower and upper limits are set for the absorption material volume fraction of the mixture, the lower limit substantially by the need to ensure the desired absorption effect and the upper limit substantially by miscibility. It preferably amounts to from just a few percent to approx. 75%, particularly preferably from approx. 10 to 30%.

The absorption material absorbing the electromagnetic radiation is preferably embedded in the mixture in the form of small particles. These particles typically have an average diameter of approx. 1 to 100 μm, preferably 2 to 10 μm. It is also possible to use nanoparticles. The particulate structure of the absorption material has the advantage that flowability is thereby produced without the absorption material itself having to be fluid. The particles may be surface-coated, in order to influence favorably their properties such as for example flowability. The particles may likewise be coated with a fusible material, which may in particular be the material which is flowable in the processing state.

The material flowable in the processing state may in particular be a polymer. In particular, the material may be a thermoplastic polymer, which by definition softens when heated and may thereby be given any desired permanent shape. Suitable thermoplastics are in particular polypropylene (PP), liquid crystal polymers (LCP), polyamide (PA), polycarbonate (PC) and/or polyoxymethylene (POM). Furthermore, the material flowable in the processing state may be a polymer which is uncrosslinked prior to processing and crosslinked, i.e. cured, after processing. Single-, two- or multi-component systems are especially suitable as such plastics. The plastics material may for example be an epoxy resin, which is fluid in the processing state and is cured by mixing with a curing agent or by UV radiation once it has been shaped as desired.

The absorption material absorbing the electromagnetic radiation may in particular be or contain a heavy metal, wherein the heavy metals tungsten (W), lead (Pb), bismuth (Bi), tantalum (Ta) and/or molybdenum (Mo) are preferred.

Polypropylene and tungsten or liquid crystal polymers and tungsten have proven to be particularly suitable combinations of the above-mentioned thermoplastics and heavy metals.

In a preferred geometric configuration of the grid, the wall elements exhibit a double comb structure, in which webs project on two sides from a base surface. Both the base surface and the webs may be oriented parallel to the radiation direction of incident (primary) radiation. (Primary) Radiation leaving the radiation source may then pass unhindered between two webs oriented in parallel or towards the same radiation source. On the other hand, (secondary) radiation not coming from the radiation source has a high probability of hitting one of the webs or the base surface and being absorbed there.

According to a particular development of the double comb structure, the base surface thereof takes the form of a foil absorbing electromagnetic radiation and provided with perforation holes, which foil may consist in particular of one of the above-mentioned heavy metals. In this arrangement, the webs of the double comb structure extend on both sides of the foil, wherein webs arranged back to back on different sides of the foil are connected physically through the perforation holes. In this way, a very stable double comb structure may be produced, in which the base surface is formed of a foil to which the webs are attached through their connection via the perforation holes.

A plurality of the above-described double comb structures are arranged alternately with plane lamellae of an absorbent material, such as for instance a heavy metal. In this way, a two-dimensional grid is obtained with a relatively simple structure, which serves to absorb scattered radiation.

The invention further relates to a detector, in particular an X-ray detector, which is characterized in that it comprises a grid of the above-described type for the absorption of X-rays.

The invention likewise relates to an imaging device for generating an image of an object or part of an object by X-radiation, which imaging device is characterized in that it comprises a detector of the above-mentioned type. The device may in particular be an X-ray device, an X-ray computer tomograph and/or a device for performing PET or SPECT.

In addition, the invention relates to a method of producing a grid of the above-described type with wall elements absorbing electromagnetic radiation. The method is characterized in that the wall elements are produced wholly or partially by a molding process from a mixture of a material which is flowable in the processing state and an absorption material absorbing electromagnetic radiation. Molding may in particular be performed by injection molding, in which temperatures of 220° C. and a pressure of approximately 1000 bar are typically applied.

In particular, the method may use particles of the absorption material, which are coated with the material which is flowable in the processing state. Such coated particles may firstly be introduced into the desired mold due to their flowability, after which the coating is then liquefied (e.g. melted) and distributed in the mold cavity and embeds and binds together the particle cores made from the absorption material.

The invention will be further described with reference to examples of embodiments shown in the drawings to which, however, the invention is not restricted. In the Figures.

Figure 1:
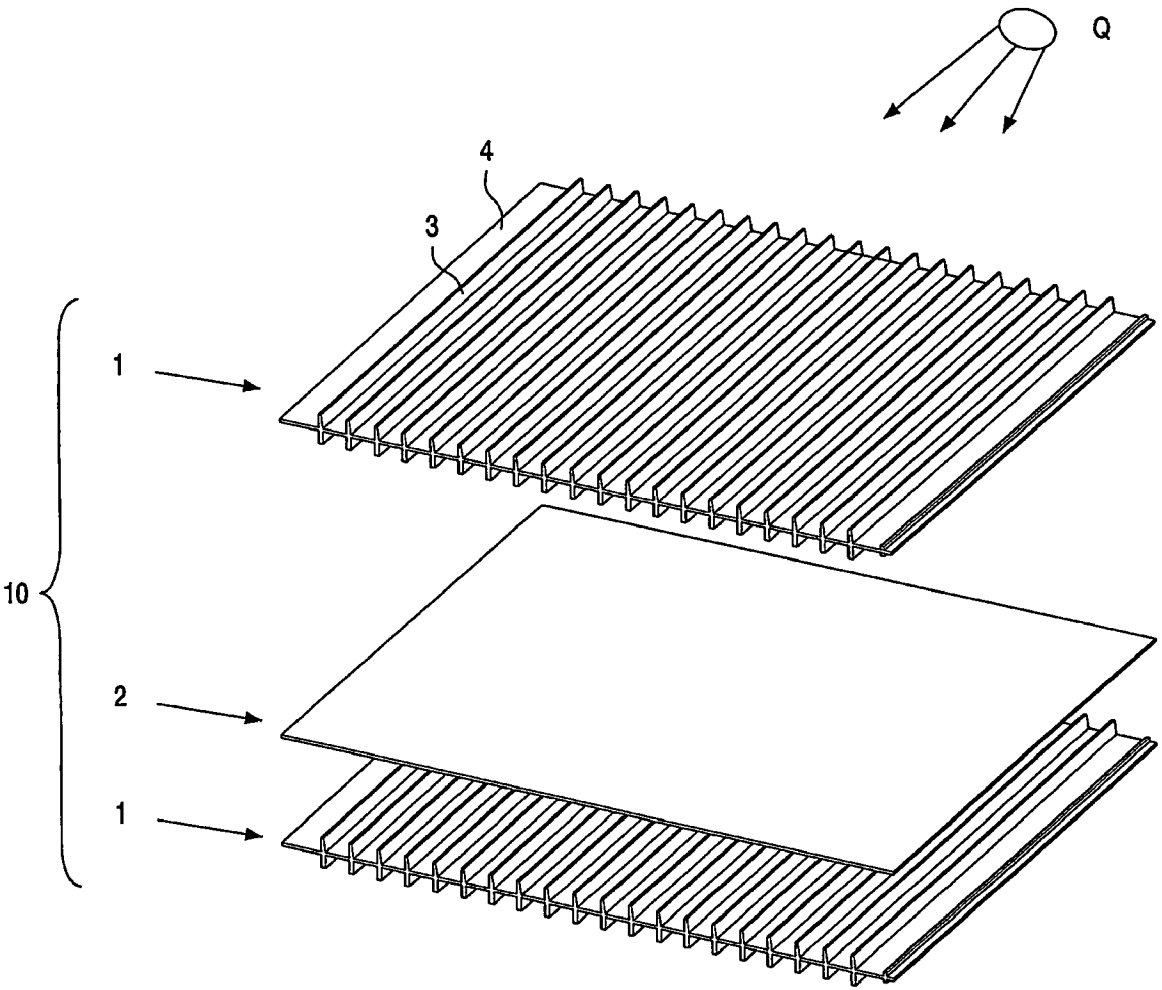
FIG. 1 is an exploded view of a portion of a grid according to the invention consisting of wall elements having a double comb structure and lamellae.

FIG. 1 is an exploded view of a preferred geometric construction of a two-dimensional grid 10 for absorbing scattered rays. The grid consists of an alternating sequence of wall elements 1 of double comb structure and flat lamellae 2. The lamellae 2 may take the form of a smooth, absorbent metal foil, such as for instance 100 μm thick molybdenum. The basic structure illustrated in the Figure should be imagined as continuing appropriately upwards and downwards in an alternating sequence . . . -1-2-1-2- . . . of wall elements 1 and lamellae 2.

The above-mentioned double comb structure of the wall elements 1 is formed by a flat base surface 4 and webs 3. The webs 3 are arranged on both sides of the base surface 4 and extend parallel to one another or are oriented towards a radiation source Q. The webs 3 lie back to back in pairs opposite one another on the two sides of the base surface 4. Transmission channels are formed between the webs 3, through which the (primary) radiation coming directly from an X-ray source Q may pass substantially unhindered, in order to reach a detector (not shown) on the other side of the anti-scatter grid 10. On the other hand, there is a high probability that (secondary) radiation not coining directly from the radiation source Q will hit a wall element 1 or a lamella 2 and be absorbed there. In this way, the proportion of the scattered radiation which reaches the detector and leads to degradation of the image information may be reduced. In the example illustrated in FIG. 1, 40 transmission channels are typically provided, each with one pixel per channel, wherein the X-ray source Q is located for instance at a distance of 1 m from the detector or anti-scatter grid 10. In other applications, however, a plurality of pixels may be assigned to one transmission channel or a plurality of transmission channels may be associated with one pixel.

Two-dimensional scatter grids 10 of the above-described type or of similar type are very difficult to produce, since they have a fine spatial structure consisting of thin walls. In order to simplify production of such grids and to allow cost-effective mass production, the use of a special material is proposed according to the present invention for producing at least parts of the grid. This special material is characterized in that it comprises a mixture of a material which is flowable in the processing state and an absorption material providing the desired absorption of (X-)radiation.

Figure 3:
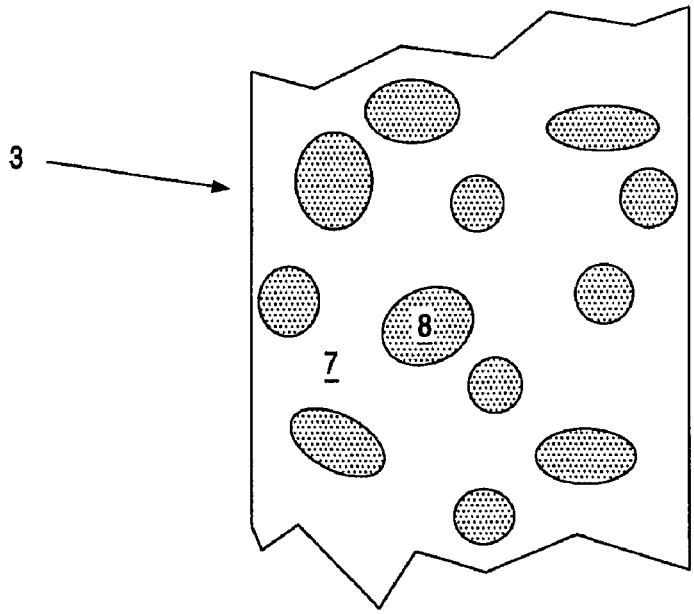
FIG. 3 is a schematic representation of the microscopic structure of the wall elements of a grid according to the invention.

A preferred microscopic structure of such a mixture is illustrated schematically in FIG. 3. Here, the mixture is a heterogeneous mixture of a thermoplastic 7 and particles 8 of a heavy metal embedded therein, wherein the heavy metal may be for example W, Pb, Bi, Ta and/or Mo. If required, the melting point of Bi may be raised by adding 5% copper, for example. Suitable thermoplastics are in particular polypropylene PP, liquid crystal polymers LCP, polyamide PA and/or polyoxymethylene POM. Particularly suitable material combinations are PP and W or LCP and W. Thus, the mixture illustrated in FIG. 3 may for example consist of PP with a volume fraction of approx. 22% W (particle size approx. 5 μm).

The mixture has the advantage that it may be converted for processing into a fluid or flowable state, in which it may be shaped virtually as desired. In particular, an injection molding process may be used (for example at 220° C. and 1000 bar), to shape the fluid mixture as desired. The thermoplastic 7 allows shaping in the plastic state, the shape being retained after setting of the plastics material, wherein the heavy metal particles 8 embedded in the plastics material ensure the desired absorption of X-rays.

In this way, the wall element 1 with double comb structure illustrated in FIG. 1 may be produced as a unit in a single (injection) molding process.

Figure 2:
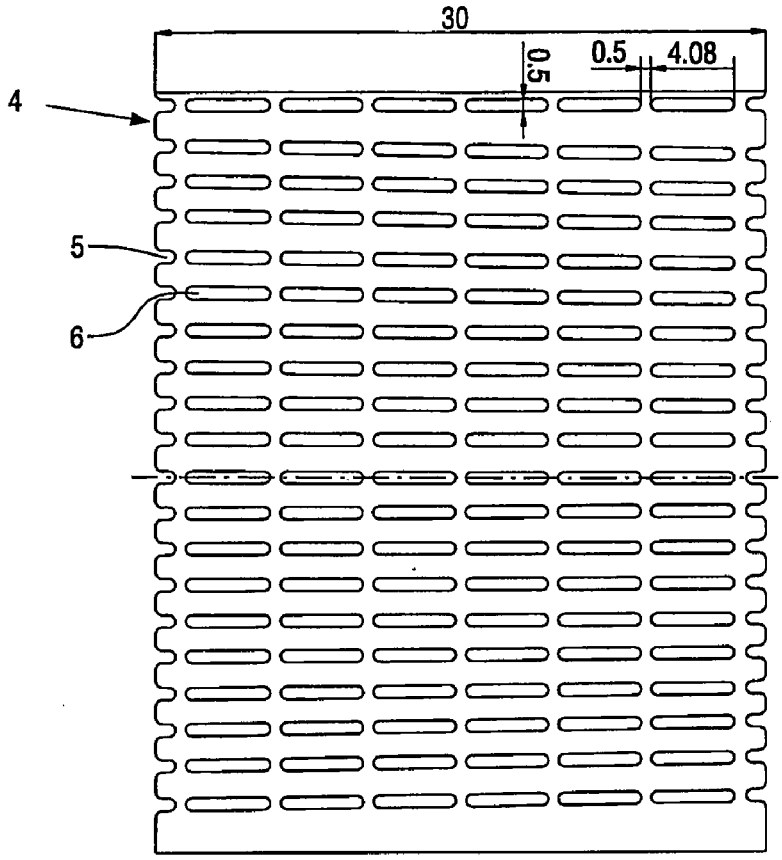
FIG. 2 shows a perforated base surface of a wall element with double comb structure.

In an alternative method of producing a wall element 1 with double comb structure, the base surface of the wall element is formed from a foil 4 of an absorbent material, for example a molybdenum foil. Such a foil 4 is illustrated in FIG. 2. It has slots or perforation holes 6 arranged in parallel rows one behind the other. The rows of perforation holes 6 are arranged with the spacing desired for the webs 3 (FIG. 1). Typical dimensions of the foil 4 and the perforation holes 6 are given in FIG. 2 in millimeters.

Starting with such a foil 4, a thermoplastic/metal mixture is then injection-molded substantially in only one direction (perpendicular to the foil 4), wherein the injection-molded thermoplastic/metal webs 3 are connected together and with the foil 4 on both sides of the foil 4 via the perforation holes 6. The advantage of such a hybrid double comb structure is greater dimensional stability and greater ease of assembly.

With the material according to the invention, it is also possible to produce a complete two-dimensional grid in one piece and in one operation, for example by injection molding.

The invention claimed is:

1. A grid having wall elements absorbing electromagnetic radiation, wherein the wall elements include a mixture of a material which is flowable in the processing state and an absorption material which absorbs the electromagnetic radiation, and wherein the wall elements exhibit a double comb structure with webs extending on two sides from a base surface, wherein the base surface takes the form of an absorbent foil provided with perforation holes, and wherein the webs are connected from one side of the foil to the other through the perforation holes.

2. A grid as claimed in claim 1, wherein the absorption material is embedded in the mixture in the form of particles.

3. A grid as claimed in claim 1, wherein the material which is flowable in the processing state contains or consists of a thermoplastic polymer selected from the group of polypropylene, liquid crystal polymer, polyamide, polycarbonate and/or polyoxymethylene.

4. A grid as claimed in claim 1, wherein the absorption material comprises a heavy metal.

5. A grid as claimed in claim 1, wherein the wall elements are arranged alternately with lamellae of an absorbent material.

6. A detector having a grid for the absorption of X-rays, wherein the grid comprises wall elements, which wall elements include a mixture of a material which is flowable in the processing state and an absorption material which absorbs electromagnetic radiation, wherein the wall elements exhibit a double comb structure with webs extending on two sides from a base surface, wherein the base surface takes the form of an absorbent foil provided with perforation holes, and wherein the webs are connected from one side of the foil to the other through the perforation holes.

7. A detector as claimed in claim 6 including radiation absorbent lamellae, wherein the wall elements are arranged alternately with the lamellae.

8. A detector as claimed in claim 6 wherein the absorption material is embedded in the mixture in the form of particles.

9. A detector as claimed in claim 6 wherein the material which is flowable in the processing state contains or consists of a thermoplastic polymer selected from the group of polypropylene, liquid crystal polymer, polyamide, polycarbonate and/or polyoxymethylene.

10. A detector as claimed in claim 6 wherein the absorption material contains or consists of a heavy metal.

11. An imaging device for generating an image of an object or part of an object by X-radiation, comprising a detector having a grid for the absorption of X-rays, wherein the grid comprises wall elements, which wall elements include a mixture of a material which is flowable in the processing state and an absorption material absorbing electromagnetic radiation, wherein the wall elements exhibit a double comb structure with webs projecting on two sides from a base surface wherein the base surface takes the form of an absorbent foil provided with perforation holes, and wherein the webs are connected from one side of the foil to the other through the perforation holes.

12. An imaging device as claimed in claim 11 wherein the wall elements are arranged alternately with the lamellae.

13. An imaging device as claimed in claim 11 wherein the absorption material is embedded in the mixture in the form of particles.

14. An imaging device as claimed in claim 11 wherein the material which is flowable in the processing state contains or consists of a thermoplastic polymer selected from the group of polypropylene, liquid crystal polymer, polyamide, polycarbonate and/or polyoxymethylene.

15. A method of producing a grid having wall elements absorbing electromagnetic radiation, wherein the wall elements are produced by injection molding from a mixture of a material which is flowable in the processing state and an absorption material absorbing electromagnetic radiation, wherein the wall elements are produced in a double comb structure with webs projecting on two sides from a base surface, wherein the base surface takes the form of an absorbent foil provided with perforation holes, and wherein the webs are connected from one side of the foil to the other through the perforation holes.

* * * * *